US006717491B2

(12) United States Patent
Liang et al.

(10) Patent No.: US 6,717,491 B2
(45) Date of Patent: Apr. 6, 2004

(54) HAIRPIN MICROSTRIP LINE ELECTRICALLY TUNABLE FILTERS

(75) Inventors: Xiao-Peng Liang, San Jose, CA (US); Yongfei Zhu, Columbia, MD (US)

(73) Assignee: Paratek Microwave, Inc., Columbia, MD (US)

( * ) Notice: Subject to any disclaimer, the term of this patent is extended or adjusted under 35 U.S.C. 154(b) by 0 days.

(21) Appl. No.: 10/123,498

(22) Filed: Apr. 16, 2002

(65) Prior Publication Data

US 2002/0158719 A1 Oct. 31, 2002

Related U.S. Application Data

(60) Provisional application No. 60/284,369, filed on Apr. 17, 2001.

(51) Int. Cl.[7] ..... H01P 1/203; H01P 7/08

(52) U.S. Cl. ..... 333/205; 333/235

(58) Field of Search ..... 333/204, 203, 333/205, 219, 235

(56) References Cited

U.S. PATENT DOCUMENTS

| | | | |
|---|---|---|---|
| 3,348,173 | A | 10/1967 | Matthaei et al. |
| 3,745,489 | A | 7/1973 | Cristal et al. |
| 4,121,182 | A | 10/1978 | Makimoto et al. |
| 4,418,324 | A | 11/1983 | Higgins |
| 4,578,656 | A | 3/1986 | Lacour et al. |
| 4,799,034 | A | 1/1989 | Silverman et al. |
| 4,835,499 | A | 5/1989 | Pickett |

(List continued on next page.)

FOREIGN PATENT DOCUMENTS

| | | |
|---|---|---|
| EP | 0 532 330 A1 | 3/1993 |
| JP | 60094501 | 5/1985 |
| WO | WO 00/35042 A1 | 6/2000 |
| WO | WO 01/15260 A1 | 3/2001 |

OTHER PUBLICATIONS

PCT International Search Report for International Application No. PCT/US02/11918 dated Oct. 9, 2002.

Sengupta L C et al. "Breakthrough Advances in Low Loss, Tunable Dielectric Materials" Materials Research Innovations, Springer, Heidelberg, DE, vol. 2, No. 5, Mar. 1999, pp. 278–282.

(List continued on next page.)

*Primary Examiner*—Barbara Summons
(74) *Attorney, Agent, or Firm*—Robert P. Lenart; James S. Finn

(57) ABSTRACT

An electronic filter includes a first microstrip line hairpin resonator including first and second arms, a first varactor connected between a first end of the first arm and a first end of the second arm of the first microstrip line hairpin resonator, a first capacitor connected between a second end of the first arm and a second end of the second arm of the first microstrip line hairpin resonator, the first and second arms being coupled to provide a first transmission zero, an input coupled to the first microstrip line hairpin resonator, a second microstrip line hairpin resonator including third and fourth arms, a second varactor connected between a first end of the third arm and a first end of the fourth arm of the second microstrip line hairpin resonator, a second capacitor connected between a second end of the third arm and a second end of the fourth arm of the second microstrip line hairpin resonator, the third and fourth arms being coupled to provide a second transmission zero, and an output coupled to the second microstrip line hairpin resonator. A resonator for an electronic filter is also disclosed. The resonator comprises a first microstrip line including first and second arms, a first varactor connected between a first end of the first arm and a first end of the second arm of the first microstrip line, and a first capacitor connected between a second end of the first arm and a second end of the second arm of the first microstrip line, with the first and second arms being coupled to provide a first transmission zero.

17 Claims, 5 Drawing Sheets

U.S. PATENT DOCUMENTS

| | | | | |
|---|---|---|---|---|
| 5,175,521 | A | | 12/1992 | Larson |
| 5,312,790 | A | | 5/1994 | Sengupta et al. |
| 5,427,988 | A | | 6/1995 | Sengupta et al. |
| 5,486,491 | A | | 1/1996 | Sengupta et al. |
| 5,543,764 | A | | 8/1996 | Turunen et al. |
| 5,578,976 | A | | 11/1996 | Yao ..... 333/262 |
| 5,616,538 | A | | 4/1997 | Hey-Shipton et al. |
| 5,635,433 | A | | 6/1997 | Sengupta |
| 5,635,434 | A | | 6/1997 | Sengupta |
| 5,693,429 | A | | 12/1997 | Sengupta et al. |
| 5,766,697 | A | | 6/1998 | Sengupta et al. |
| 5,830,591 | A | | 11/1998 | Sengupta et al. |
| 5,846,893 | A | | 12/1998 | Sengupta et al. |
| 5,888,942 | A | | 3/1999 | Matthaei |
| 5,990,766 | A | | 11/1999 | Zhang et al. |
| 6,018,282 | A | * | 1/2000 | Tsuda ..... 333/205 |
| 6,074,971 | A | | 6/2000 | Chiu et al. |
| 6,096,127 | A | | 8/2000 | Dimos et al. |
| 6,122,533 | A | | 9/2000 | Zhang et al. |
| 6,130,189 | A | | 10/2000 | Matthaei |
| 6,535,722 | B1 | * | 3/2003 | Rosen et al. ..... 333/205 |

OTHER PUBLICATIONS

U.S. patent application Ser. No. 09/419,126, Sengupta et al., filed Oct. 15, 1999.

U.S. patent application Ser. No. 09/434,433, Sengupta et al., filed Nov. 4, 1999.

U.S. patent application Ser. No. 09/594,837, Chiu, filed Jun. 15, 2000.

U.S. patent application Ser. No. 09/660,309, Zhu et al., filed Sep. 12, 2000.

U.S. patent application Ser. No. 09/734,969, Zhu et al., filed Dec. 12, 2000.

U.S. patent application Ser. No. 09/768,690, Sengupta et al., filed Jan. 24, 2001.

U.S. patent application Ser. No. 09/834,327, Chang et al., filed Apr. 13, 2001.

U.S. patent application Ser. No. 09/882,605, Sengupta, filed Jun. 15, 2001.

U.S. patent application Ser. No. 60/295,046, Luna et al., filed Jun. 1, 2001.

G. L. Matthaei et al., "Hairpin–Comb Filters for HTS and Other Narrow–Band Applications," *IEEE Transactions on Microwave Theory and Techniques,* vol. 45, No. 8, Aug. 1997, pp. 1126–1231.

A. R. Brown et al., "A Varactor Tuned RF Filter," *IEEE Trans. on MTT,* Oct. 29, 1999, pp. 1–4.

* cited by examiner

HAIRPIN MICROSTRIP LINE ELECTRICALLY TUNABLE FILTERS

CROSS REFERENCE TO RELATED APPLICATION

This application claims the benefit of U.S. Provisional Application No. 60/284,369 filed Apr. 17, 2001.

FIELD OF INVENTION

This invention generally relates to electronic filters, and more particularly, to tunable microstrip line resonator filters.

BACKGROUND OF INVENTION

The number of wireless communication systems has increased in the last decade, crowding the available radio frequency spectrum. Filter products used in radios have been required to provide improved performance with smaller size. Efforts have been made to develop new types of resonators, new coupling structures and new filter configurations. One of the techniques for reducing the number of resonators is to add cross couplings between non-adjacent resonators to provide transmission zeros. As a result of these transmission zeros, the filter selectivity is improved. However, in order to achieve these transmission zeros, certain coupling patterns have to be followed. This impedes the size reduction effort.

Electrically tunable microwave filters are highly desirable for communications applications. Magnetically and mechanically tunable filters are large and heavy. Electrically tunable filters use electrically tunable varactors in combination with the filter resonators. When the varactor capacitance is electrically tuned, the resonator resonant frequency is adjusted, which results in a change in the filter frequency response. Electrically tunable filters have the important advantages of small size, light weight, low power consumption, simple control circuits, and fast tuning capability. Traditional electronically tunable filters use semiconductor diode varactors. Compared with the semiconductor diode varactors, tunable dielectric varactors have the merits of lower loss, higher power-handling, higher IP3, and faster tuning speed. For most tunable filter applications, it is desirable to keep the filter configuration simple, otherwise it will be hard to tune the filter from one frequency to the other and still to maintain reasonable filter performance.

Tunable filters for wireless mobile and portable communication applications must be small in size and must have a relatively uncomplicated coupling structure. These design requirements mean that adding cross coupling to achieve transmission zeros, especially of the elliptic function type, is not a good option.

For miniaturization, a hairpin resonator structure has been widely used in microstrip line filters, especially for filters employing high temperature superconductor (HTS) materials. See for example, U.S. Pat. No. 3,745,489 by Cristal et al. for "Microwave And UHF Filters Using Discrete Hairpin Resonators". It has been noticed that such filters have a transmission zero near the low end of the operating frequency, which results in an improvement in the filter selectivity at the low frequency side, but a degradation in the filter selectivity at the high frequency side, even though, theoretical analysis shows that the transmission zero should be at the high frequency side. See, George L. Matthaei, Neal O. Fenzi, Roger J. Forse, and Stephan M. Rohlfing, "Hairpin-Comb Filters for HTS and Other Narrow-Band Applications," IEEE Trans. On MTT-45, August 1997, pp 1226–1231.

Tunable ferroelectric materials are materials whose permittivity (more commonly called dielectric constant) can be varied by varying the strength of an electric field to which the materials are subjected. Even though these materials work in their paraelectric phase above the Curie temperature, they are conveniently called "ferroelectric" because they exhibit spontaneous polarization at temperatures below the Curie temperature. Tunable ferroelectric materials including barium-strontium titanate (BSTO) or BSTO composites have been the subject of several patents.

Dielectric materials including barium strontium titanate are disclosed in U.S. Pat. No. 5,312,790 to Sengupta, et al. entitled "Ceramic Ferroelectric Material"; U.S. Pat. No. 5,427,988 to Sengupta, et al. entitled "Ceramic Ferroelectric Composite Material-BSTO-MgO"; U.S. Pat. No. 5,486,491 to Sengupta, et al. entitled "Ceramic Ferroelectric Composite Material—BSTO-$ZrO_2$"; U.S. Pat. No. 5,635,434 to Sengupta, et al. entitled "Ceramic Ferroelectric Composite Material-BSTO-Magnesium Based Compound"; U.S. Pat. No. 5,830,591 to Sengupta, et al. entitled "Multilayered Ferroelectric Composite Waveguides"; U.S. Pat. No. 5,846,893 to Sengupta, et al. entitled "Thin Film Ferroelectric Composites and Method of Making"; U.S. Pat. No. 5,766,697 to Sengupta, et al. entitled "Method of Making Thin Film Composites"; U.S. Pat. No. 5,693,429 to Sengupta, et al. entitled "Electronically Graded Multilayer Ferroelectric Composites"; U.S. Pat. No. 5,635,433 to Sengupta, entitled "Ceramic Ferroelectric Composite Material-BSTO-ZnO"; and U.S. Pat. No. 6,074,971 by Chiu et al. entitled "Ceramic Ferroelectric Composite Materials with Enhanced Electronic Properties BSTO-Mg Based Compound-Rare Earth Oxide". These patents are hereby incorporated by reference. The materials shown in these patents, especially BSTO-MgO composites, show low dielectric loss and high tunability. Tunability is defined as the fractional change in the dielectric constant with applied voltage.

In addition, the following U.S. patent applications, assigned to the assignee of this application, disclose additional examples of tunable dielectric materials: U.S. application Ser. No. 09/594,837 filed Jun. 15, 2000, entitled "Electronically Tunable Ceramic Materials Including Tunable Dielectric and Metal Silicate Phases" (International Publication No. WO 01/96258 A1); U.S. application Ser. No. 09/768,690 filed Jan. 24, 2001, entitled "Electronically Tunable, Low-Loss Ceramic Materials Including a Tunable Dielectric Phase and Multiple Metal Oxide Phases"; U.S. application Ser. No. 09/882,605 filed Jun. 15, 2001, entitled "Electronically Tunable Dielectric Composite Thick Films And Methods Of Making Same" (International Publication No. WO 01/99224 A1); U.S. application Ser. No. 09/834,327 filed Apr. 13, 2001, entitled "Strain-Relieved Tunable Dielectric Thin Films"; and U.S. Provisional Application Serial No. 60/295,046 filed Jun. 1, 2001 entitled "Tunable Dielectric Compositions Including Low Loss Glass Frits". These patent applications are incorporated herein by reference.

Examples of filters including tunable dielectric materials are shown in U.S. patent application Ser. No. 09/734,969 (International Publication No. WO 00/35042 A1), the disclosure of which is hereby incorporated by reference.

There is a need for tunable electronic filters that maintain structural simplicity, are relatively small, and provide transmission zeros.

SUMMARY OF THE INVENTION

An electronic filter constructed in accordance with this invention includes a first microstrip line hairpin resonator including first and second arms, a first varactor connected between a first end of the first arm and a first end of the second arm of the first microstrip line hairpin resonator, a first capacitor connected between a second end of the first arm and a second end of the second arm of the first microstrip line hairpin resonator, the first and second arms being coupled to provide a first transmission zero, an input coupled to the first microstrip line hairpin resonator, a second microstrip line hairpin resonator including third and fourth arms, a second varactor connected between a first end of the third arm and a first end of the fourth arm of the second microstrip line hairpin resonator, a second capacitor connected between a second end of the third arm and a second end of the fourth arm of the second microstrip line hairpin resonator, the third and fourth arms being coupled to provide a second transmission zero, and an output coupled to the second microstrip line hairpin resonator. The first and second arms and the third and fourth arms are substantially parallel to each other.

The capacitance of the varactors, and thus the frequency response of the filter, can be controlled by applying a control voltage to each of the first and second varactors. The first and second microstrip line hairpin resonators can be coupled to form a Chebyshev type of filter response. Each of the varactors can comprise a layer of tunable dielectric material, and first and second electrodes positioned adjacent to the layer of tunable dielectric material. The varactors can alternatively comprise a microelectromechanical capacitors or semiconductor diode varactors.

The invention also encompasses a resonator for an electronic filter comprising a first microstrip line including first and second arms, a first varactor connected between a first end of the first arm and a first end of the second arm of the first microstrip line, and a first capacitor connected between a second end of the first arm and a second end of the second arm of the first microstrip line, the first and second arms being coupled to provide a transmission zero.

DETAILED DESCRIPTION OF THE INVENTION

This invention uses tunable capacitors in microstrip line resonator filters to make tunable filters. The invention provides compact, high performance, low loss, and low cost tunable filters. These compact tunable filters are suitable for wireless communication applications. In one embodiment, the tunable varactors utilize high Q, low loss, tunable dielectric material films. The dielectric constant of the material can be changed when voltage is applied to it. These materials, that change dielectric properties through the application of a DC bias voltage, can be used in the resonator of a filter structure allowing the filter to be electronically tuned across broad frequency bands. This opens the possibility of replacing many narrow band, fixed frequency designs with a single tunable design, thereby reducing inventory and associated costs without sacrificing performance or increasing unit cost.

This invention provides a modified hairpin resonator and tunable filters that incorporate one or more of the resonators, and can also provide an elliptic function type of transmission zeros. The filter coupling configuration is as simple as in a Chebyshev filter, and the filter performance can be maintained for a relatively wider tuning range.

Figure 1:
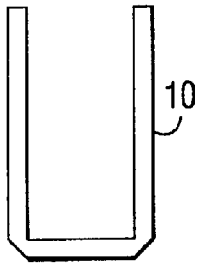
FIG. 1 PRIOR ART
FIG. 1 is a schematic representation of a prior art hairpin resonator.
Figure 2:
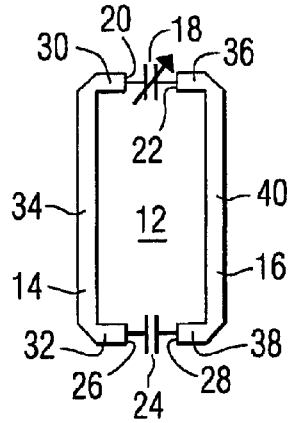
FIG. 2 is a schematic representation of a hairpin resonator constructed in accordance with this invention.

Referring to the drawings, FIG. 1 shows a prior art resonator 10 constructed of a U-shaped microstrip line that would be supported by a substrate, not shown. A modified hairpin resonator 12 constructed in accordance with this invention is shown in FIG. 2. The hairpin resonator 12 is shown in FIG. 2 has two arms 14 and 16 that are positioned substantially parallel to each other. A tunable varactor 18 is connected between first ends 20, 22 of the two arms, and a relatively high value DC blocking capacitor 24 is connected between second ends 26, 28 of the two arms opposite the first ends thereof, to allow for a DC bias voltage being added to the resonator. By adding the varactor to the hairpin resonator, the resonator becomes somewhat similar to a ring resonator. However, it still functions as a hairpin resonator due to the coupling between the two resonator arms, because a ring resonator usually does not consider the possible coupling between different portions of the same resonator. It is because of this inter-arm coupling that transmission zeros are obtained in the filter design. The position of the transmission zeros, including frequency location and rejection level, depends on the distance between the two arms.

In the resonator of FIG. 2, resonator arm 14 includes portions 30 and 32 that extend perpendicularly from a straight section 34, and resonator arm 16 includes portions 36 and 38 that extend perpendicularly from a straight section 40. The overall length of the hairpin is in the range of one quarter wavelength.

Figure 3:
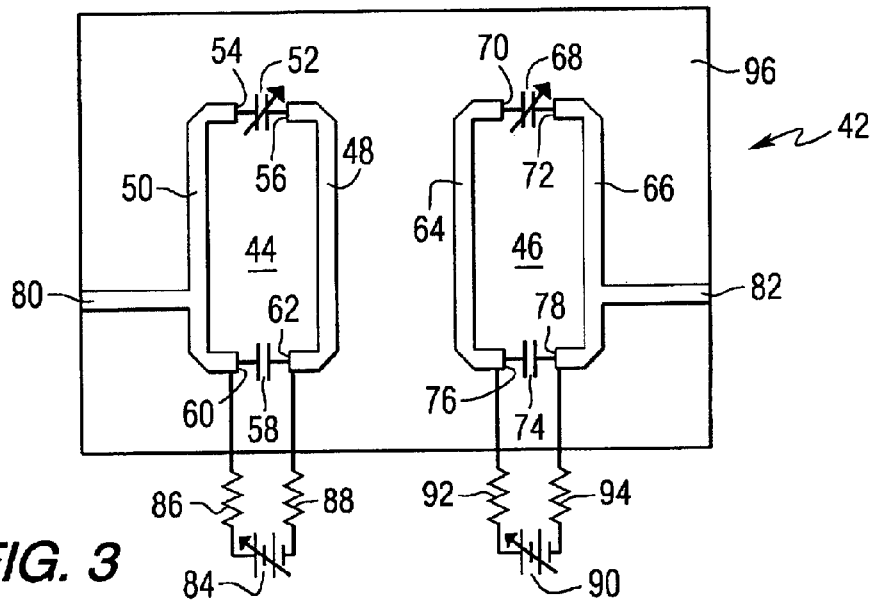
FIG. 3 is a schematic representation of a 2-pole hairpin microstrip line resonator tunable bandpass filter constructed in accordance with this invention.

A two-pole filter 42 constructed in accordance with this invention is shown in FIG. 3. The filter 42 includes two hairpin resonators 44 and 46. The first hairpin resonator 44 includes first and second arms 48, 50 that lie substantially parallel to each other. A first varactor 52 is connected between arms 48 and 50 at first ends 54, 56 thereof. A DC blocking capacitor 58 is connected between arms 48 and 50 between second ends 60, 62 thereof. The second hairpin resonator 46 includes first and second arms 64, 66 that lie substantially parallel to each other. A second varactor 68 is connected between arms 64 and 66 at first ends 70, 72 thereof. A DC blocking capacitor 74 is connected between arms 64 and 66 at second ends 76, 78 thereof. An input 80 is connected to the first resonator and an output 82 is connected to the second resonator. A first variable DC voltage source 84 is connected to the first and second arms of resonator 44 through resistors 86 and 88 to provide a bias voltage to varactor 52. A second variable DC voltage source 90 is connected to the first and second arms of resonator 46 through resistors 92 and 94 to provide a bias voltage to varactor 68. The bias voltages supplied by the variable DC voltage sources control the capacitance of the varactors and thereby control the frequency response of the filter.

The microstrip lines that form the hairpin resonators are mounted on a dielectric substrate 90. The resonators are positioned adjacent to each other so that one arm 48 of a first one of the resonators is electrically coupled to one arm 64 of the other resonator. The first and second arms of the first resonator are coupled to each other to produce a first transmission zero positioned in frequency on one side of the filter passband. The first and second arms of the second resonator are coupled to each other to produce a second transmission zero positioned in frequency on the other side of the filter passband. The resistors in the bias circuit present an impedance that is large with respect to the impedance of the microstrip lines in the resonator, thus serving to block radio frequency signals form passing through the bias circuit. For example, the impedance of the microstrip lines can be on the order of 50 Ω, while the resistance of the resistors can be on the order of 50 kΩ.

The filter of FIG. 3 has two transmission zeros, one at each side of the passband in frequency. One embodiment of the filter shown in FIG. 3 includes microstrip lines on a substrate having a dielectric constant of 10.2 and a thickness of 1.0 mm (0.025 inch). This filter design works at 2.0 GHz. The varactors can be constructed in accordance with the varactor structures shown in U.S. patent application Ser. No. 09/419,126, filed Oct. 15, 1999 (PCT/US99/24161); Ser. No. 09/434,433, filed Nov. 4, 1999 (PCT/US99/26113); or Ser. No. 09/660,309, filed Sep. 12, 2000, all of which are incorporated by reference.

Figure 4:
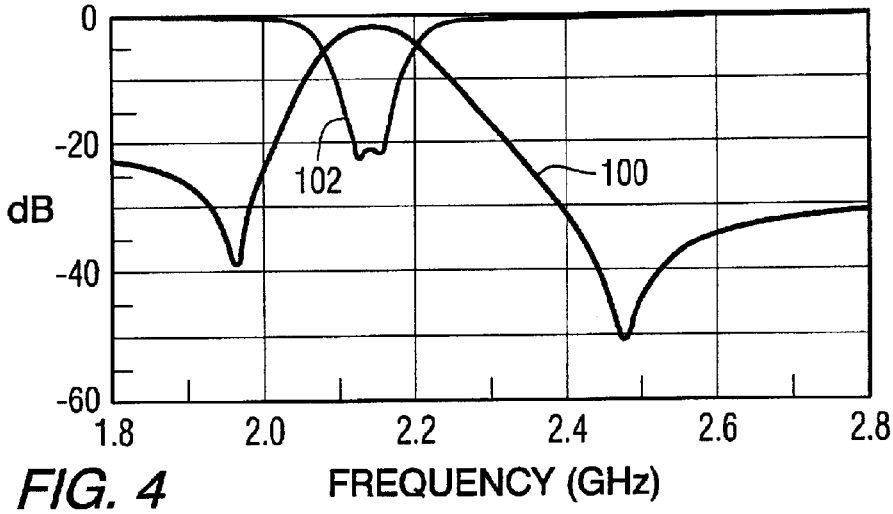
FIG. 4 is a graph of a simulated response of the filter of FIG. 3.
Figure 5:
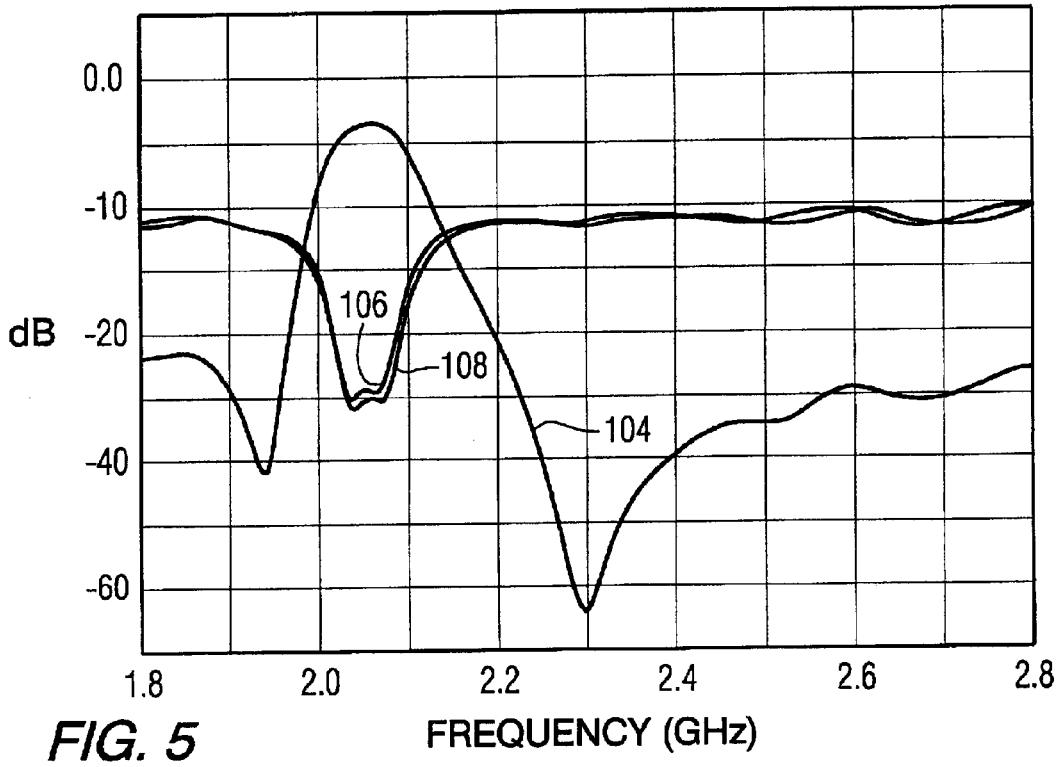
FIG. 5 is a graph of a measured response constructed in accordance with this invention with 0 volt DC bias voltage applied to the varactors.

Simulated filter performance for the filter of FIG. 3 is shown in FIG. 4. Curve 100 illustrates the filter zeros on each end of the passband shown as curve 102. FIG. 5 gives the measured filter response for the filter of FIG. 3 at zero volts bias voltage, which matches the predicted response very well. Curve 104 shows the two zeros at opposite ends of the passband illustrated by curves 106 and 108.

As it can be seen, an elliptic function type of filter response is clearly demonstrated. The two zeros are provided by the coupling between the two arms of the same resonator. Properly adjusting the space between the two arms of each resonator can control the transmission zeros to be closer or further away from the filter passband.

Figure 6:
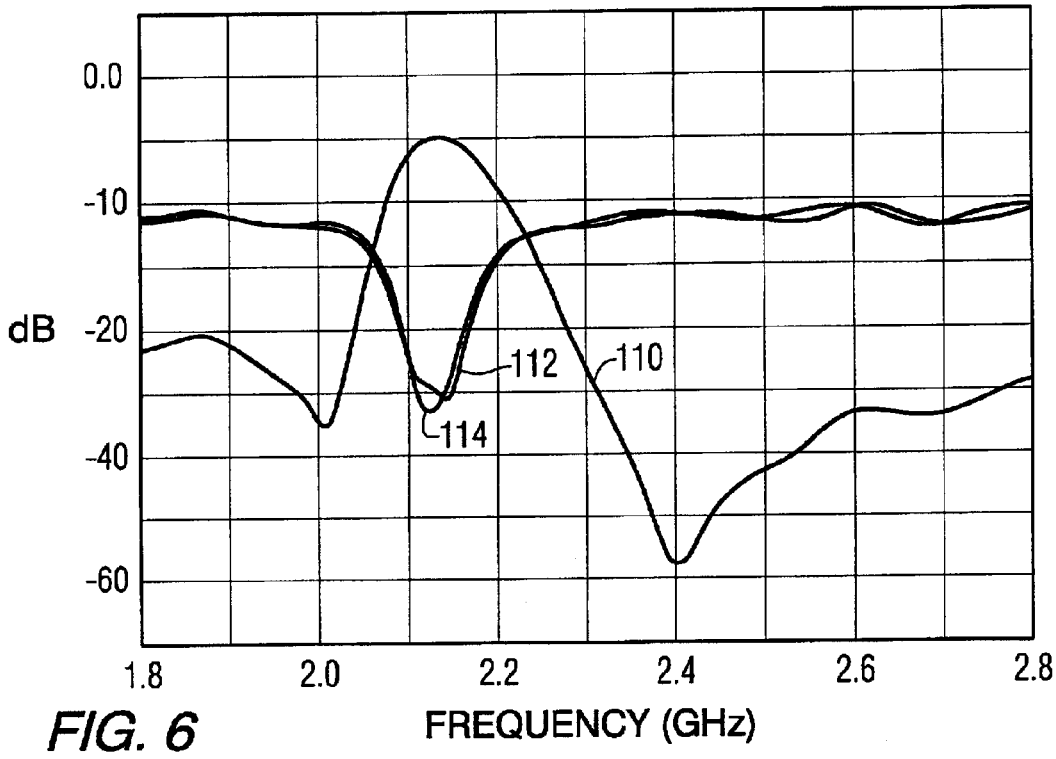
FIG. 6 is a graph of a measured response constructed in accordance with this invention at 50 volts DC bias voltage applied to the varactors.

FIG. 6 gives the filter responses for the filter of FIG. 3 with a DC bias voltage of 50 volts on the varactors. Curve 110 shows the two zeros at opposite ends of the passband illustrated by curves 112 and 114. Filter performance can be well maintained with tuning.

Figure 7:
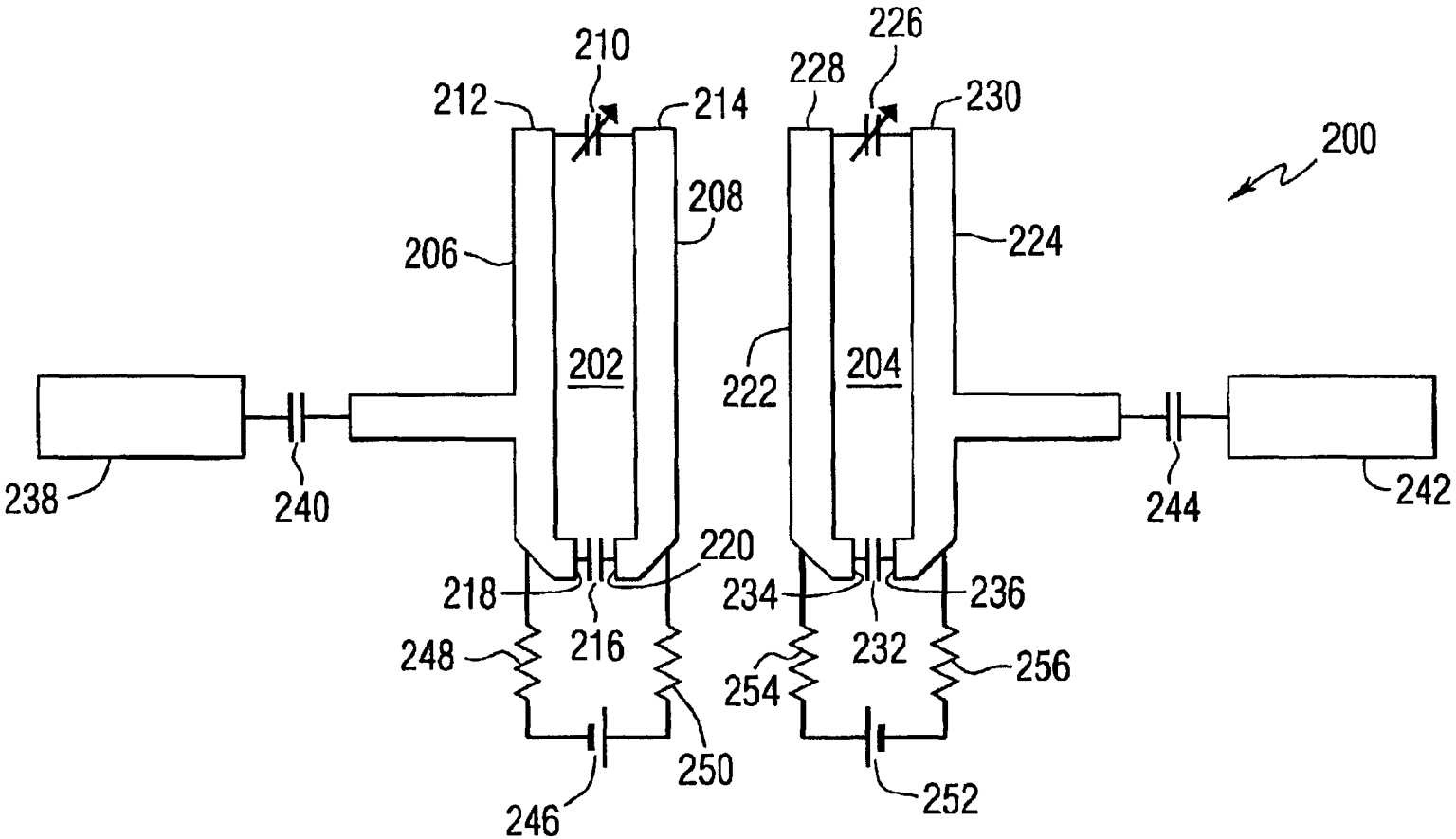
FIG. 7 is a schematic representation of another 2-pole hairpin microstrip line resonator tunable bandpass filter constructed in accordance with this invention.

FIG. 7 is a schematic representation of another two-pole filter 200 constructed in accordance with this invention. The filter 200 includes two hairpin resonators 202 and 204. The first hairpin resonator 202 includes first and second arms 206, 208 that lie substantially parallel to each other. A first varactor 210 is connected between arms 206 and 208 at first ends 212, 214 thereof. A DC blocking capacitor 216 is connected between arms 206 and 208 between second ends 218, 220 thereof. The second hairpin resonator 204 includes first and second arms 222, 224 that lie substantially parallel to each other. A second varactor 226 is connected between arms 222 and 224 at first ends 228, 230 thereof. A DC blocking capacitor 232 is connected between arms 222 and 224 at second ends 234, 236 thereof. An input 238 is coupled to the first resonator through a third DC blocking capacitor 240, and an output 242 is coupled to the second resonator through a fourth DC blocking capacitor 244. A first variable DC voltage source 246 is connected to the first and second arms of resonator 202 through resistors 248 and 250 to provide a bias voltage to varactor 210. A second variable DC voltage source 252 is connected to the first and second arms of resonator 204 through resistors 254 and 256 to provide a bias voltage to varactor 226. The bias voltages supplied by the variable DC voltage sources control the capacitance of the varactors and thereby control the frequency response of the filter.

The resonators are positioned adjacent to each other so that one arm of a first one of the resonators is electrically coupled to one arm of the other resonator. The first and second arms of the first resonator are coupled to each other to produce a first transmission zero positioned in frequency on one side of the filter passband. The first and second arms of the second resonator are coupled to each other to produce a second transmission zero positioned in frequency on the other side of the filter passband. The resistors in the bias circuit present an impedance that is large with respect to the impedance of the microstrip lines in the resonator, thus serving to block radio frequency signals form passing through the bias circuit. For example, the impedance of the microstrip lines can be on the order of 50 Ω, while the resistance of the resistors can be on the order of 50 kΩ.

Figure 8:
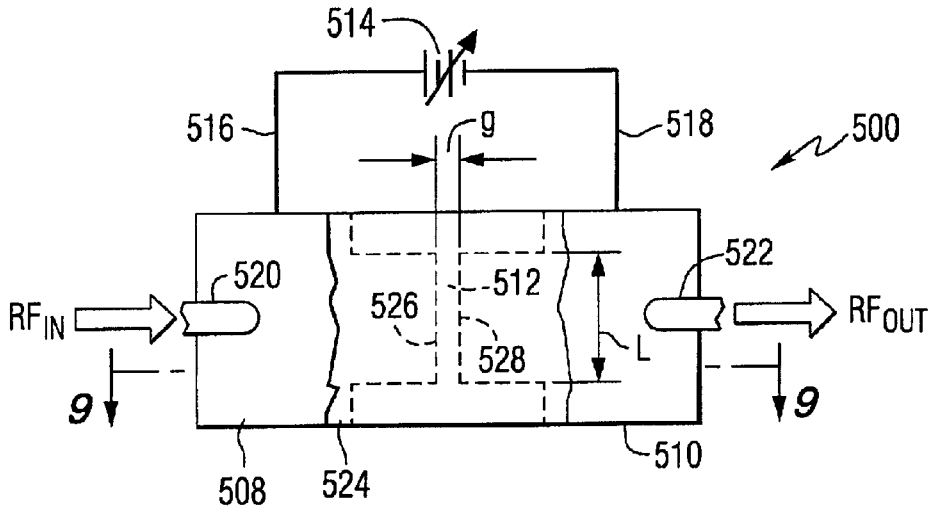
FIG. 8 is a top plan view of a voltage tunable dielectric varactor that can be used in the filters of the present invention.
Figure 9:
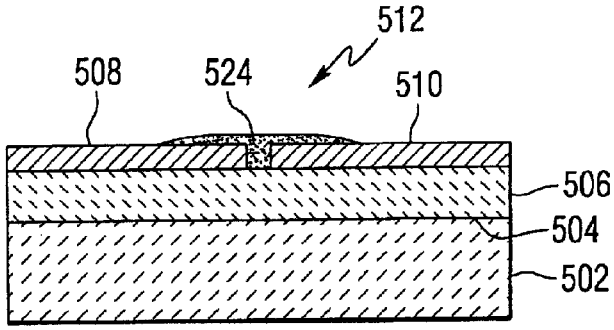
FIG. 9 is a cross sectional view of the varactor of FIG. 8, taken along line 9—9.

FIGS. 8 and 9 are top and cross sectional views of a voltage tunable dielectric varactor 500 that can be used in filters constructed in accordance with this invention. The varactor 500 includes a substrate 502 having a generally planar top surface 504. A tunable ferroelectric layer 506 is positioned adjacent to the top surface of the substrate. A pair of metal electrodes 508 and 510 are positioned on top of the ferroelectric layer. The substrate 502 is comprised of a material having a relatively low permittivity such as MgO, Alumina, $LaAlO_3$, Sapphire, or a ceramic. For the purposes of this description, a low permittivity is a permittivity of less than about 30. The tunable ferroelectric layer 506 is comprised of a material having a permittivity in a range from about 20 to about 2000, and having a tunability in the range from about 10% to about 80% when biased by an electric field of about 10 V/$\mu$m. The tunable dielectric layer can be comprised of Barium-Strontium Titanate, $Ba_xSr_{1-x}TiO_3$ (BSTO), where x can range from zero to one, or BSTO-composite ceramics. Examples of such BSTO composites include, but are not limited to: BSTO-MgO, BSTO-$MgAl_2O_4$, BSTO-$CaTiO_3$, BSTO-$MgTiO_3$, BSTO-$MgSrZrTiO_6$, and combinations thereof. The tunable layer can have a dielectric permittivity greater than 100 when subjected to typical DC bias voltages, for example, voltages ranging from about 5 volts to about 300 volts. A gap 528 of width g, is formed between the electrodes 508 and 510. The gap width can be optimized to increase the ratio of the maximum capacitance $C_{max}$ to the minimum capacitance $C_{min}$ ($C_{max}/C_{min}$) and increase the quality factor (Q) of the device. The optimal width, g, is the width at which the device has maximum $C_{max}/C_{min}$ and minimal loss tangent. The width of the gap can range from 5 to 50 $\mu$m depending on the performance requirements.

A controllable voltage source 514 is connected by lines 516 and 518 to electrodes 508 and 510. This voltage source is used to supply a DC bias voltage to the ferroelectric layer, thereby controlling the permittivity of the layer. The varactor also includes an RF input 520 and an RF output 522. The RF input and output are connected to electrodes 18 and 20, respectively, such as by soldered or bonded connections.

In typical embodiments, the varactors may use gap widths of less than 50 $\mu$m, and the thickness of the ferroelectric layer can range from about 0.1 $\mu$m to about 20 $\mu$m. A sealant 524 can be positioned within the gap and can be any non-conducting material with a high dielectric breakdown strength to allow the application of a high bias voltage without arcing across the gap. Examples of the sealant include epoxy and polyurethane.

The length of the gap L can be adjusted by changing the length of the ends 526 and 528 of the electrodes. Variations in the length have a strong effect on the capacitance of the varactor. The gap length can be optimized for this parameter. Once the gap width has been selected, the capacitance becomes a linear function of the length L. For a desired capacitance, the length L can be determined experimentally, or through computer simulation.

The thickness of the tunable ferroelectric layer also has a strong effect on the $C_{max}/C_{min}$ ratio. The optimum thickness of the ferroelectric layer is the thickness at which the maximum $C_{max}/C_{min}$ occurs. The ferroelectric layer of the varactor of FIGS. 9 and 10 can be comprised of a thin film, thick film, or bulk ferroelectric material such as Barium-Strontium Titanate, $Ba_xSr_{1-x}TiO_3$ (BSTO), BSTO and various oxides, or a BSTO composite with various dopant materials added. All of these materials exhibit a low loss tangent. For the purposes of this description, for operation at frequencies ranging from about 1.0 GHz to about 10 GHz, the loss tangent would range from about 0.001 to about 0.005. For operation at frequencies ranging from about 10 GHz to about 20 GHz, the loss tangent would range from about 0.005 to about 0.01. For operation at frequencies ranging from about 20 GHz to about 30 GHz, the loss tangent would range from about 0.01 to about 0.02.

The electrodes may be fabricated in any geometry or shape containing a gap of predetermined width. The required current for manipulation of the capacitance of the varactors disclosed in this invention is typically less than 1 $\mu$A. In one example, the electrode material is gold. However, other conductors such as copper, silver or aluminum, may also be used. Gold is resistant to corrosion and can be readily bonded to the RF input and output. Copper provides high conductivity, and would typically be coated with gold for bonding or with nickel for soldering.

Figure 10:
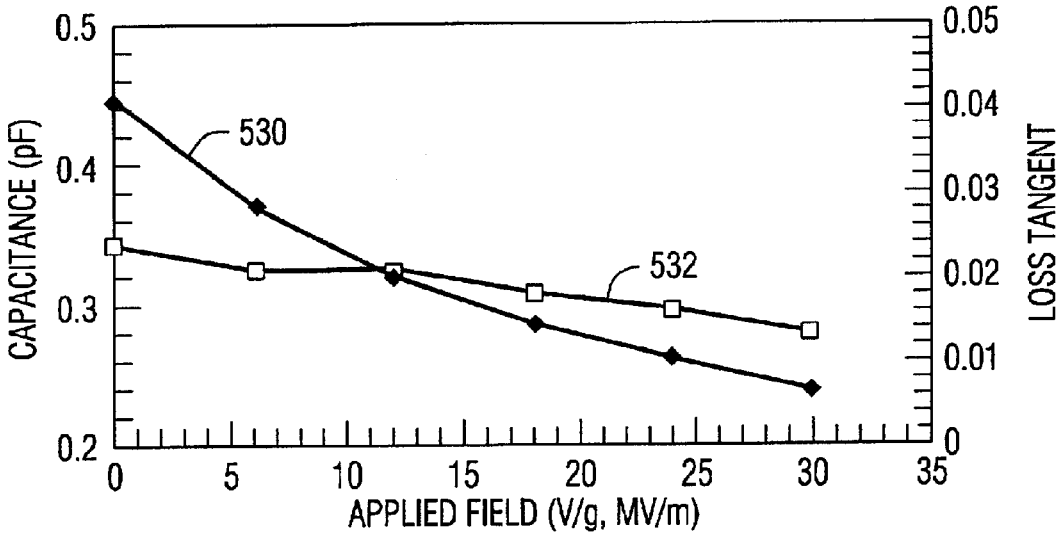
FIG. 10 is a graph that illustrates the properties of the dielectric varactor of FIG. 8.

Voltage tunable dielectric varactors as shown in FIGS. 8 and 9 can have Q factors ranging from about 50 to about 1,000 when operated at frequencies ranging from about 1 GHz to about 40 GHz. The typical Q factor of the dielectric varactor is about 1000 to 200 at 1 GHz to 10 GHz, 200 to 100 at 10 GHz to 20 GHz, and 100 to 50 at 20 to 30 GHz. $C_{max}/C_{min}$ is about 2, which is generally independent of frequency. The capacitance (in pF) and the loss factor (tan $\delta$) of a varactor measured at 20 GHz for gap distance of 10 $\mu$m at 300° K is shown in FIG. 10. Line 530 represents the capacitance and line 532 represents the loss tangent.

Figure 11:
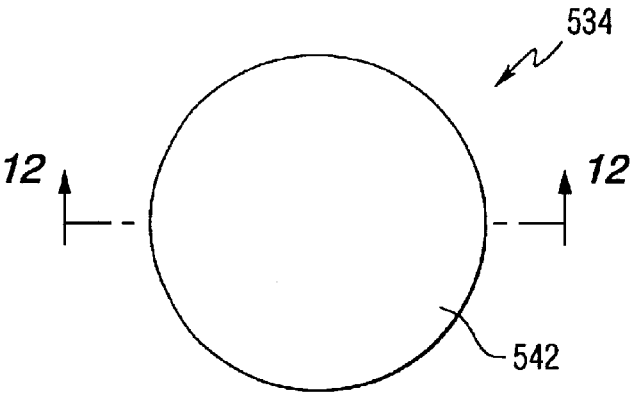
FIG. 11 is a top plan view of another voltage tunable dielectric varactor that can be used in the filters of the present invention.
Figure 12:
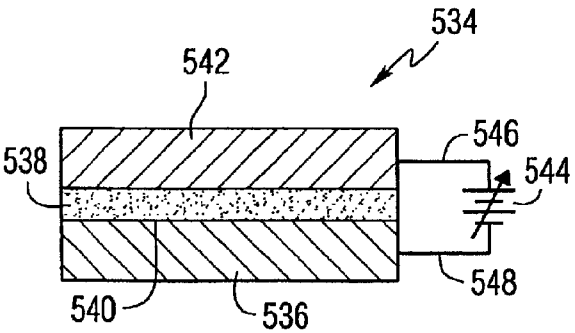
FIG. 12 is a cross sectional view of the varactor of FIG. 11, taken along line 12—12.

FIG. 11 is a top plan view of a voltage controlled tunable dielectric capacitor 534 that can be used in the filters of this invention. FIG. 12 is a cross sectional view of the capacitor 534 of FIG. 11 taken along line 12—12. The capacitor includes a first electrode 536, a layer, or film, of tunable dielectric material 538 positioned on a surface 540 of the first electrode, and a second electrode 542 positioned on a side of the tunable dielectric material 538 opposite from the first electrode. The first and second electrodes are preferably metal films or plates. An external voltage source 544 is used to apply a tuning voltage to the electrodes, via lines 546 and 548. This subjects the tunable material between the first and second electrodes to an electric field. This electric field is used to control the dielectric constant of the tunable dielectric material. Thus the capacitance of the tunable dielectric capacitor can be changed.

Figure 13:
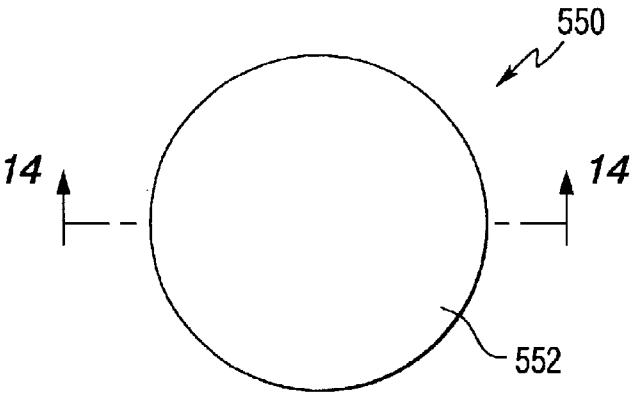
FIG. 13 is a top plan view of another voltage tunable dielectric varactor that can be used in the filters of the present invention.
Figure 14:
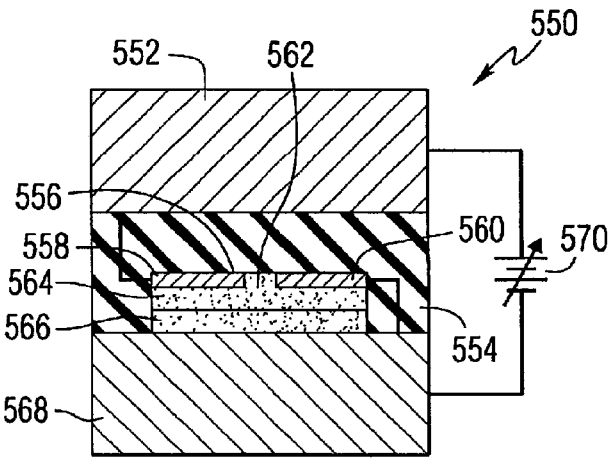
FIG. 14 is a cross sectional view of the varactor of FIG. 13, taken along line 14—14.

FIG. 13 is a top plan view of another voltage controlled tunable dielectric capacitor 550 that can be used in the filters of this invention. FIG. 14 is a cross sectional view of the capacitor of FIG. 13 taken along line 14—14. The tunable dielectric capacitor of FIGS. 13 and 14 includes a top conductive plate 552, a low loss insulating material 554, a bias metal film 556 forming two electrodes 558 and 560 separated by a gap 562, a layer of tunable material 564, a low loss substrate 566, and a bottom conductive plate 568. The substrate 566 can be, for example, MgO, $LaAlO_3$, alumina, sapphire or other materials. The insulating material can be, for example, silicon oxide or a benzocyclobutene-based polymer dielectric. An external voltage source 570 is used to apply voltage to the tunable material between the first and second electrodes to control the dielectric constant of the tunable material.

The tunability may be defined as the dielectric constant of the material with an applied voltage divided by the dielectric constant of the material with no applied voltage. Thus, the voltage tunability percentage may be defined by the formula:

$$T=((X-Y)/X)\cdot 100;$$

where X is the dielectric constant with no voltage and Y is the dielectric constant with a specific applied voltage. High tunability is desirable for many applications. The voltage tunable dielectric materials preferably exhibit a tunability of at least about 20 percent at 8V/micron, more preferably at least about 25 percent at 8V/micron. For example, the voltage tunable dielectric material may exhibit a tunability of from about 30 to about 75 percent or higher at 8V/micron.

The tunable dielectric film of the tunable capacitors can be Barium-Strontium Titanate, $Ba_xSr_{1-x}TiO_3$ (BSTO) where $0<x<1$, BSTO-oxide composite, or other voltage tunable materials. Between electrodes 508 and 510, the gap 524 has a width g, known as the gap distance. This distance g must be optimized to have a higher $C_{max}/C_{min}$ ratio in order to reduce bias voltage, and increase the Q of the tunable dielectric capacitor. The typical g value is about 10 to 30 $\mu$m. The thickness of the tunable dielectric layer affects the ratio $C_{max}/C_{min}$ and Q. For tunable dielectric capacitors, parameters of the structure can be chosen to have a desired trade off among Q, capacitance ratio, and zero bias capacitance of the tunable dielectric capacitor. The typical Q factor of the tunable dielectric capacitor is about 200 to 500 at 1 GHz, and 50 to 100 at 20 to 30 GHz. The $C_{max}/C_{min}$ ratio is about 2, which is independent of frequency.

A wide range of capacitance of the tunable dielectric capacitors is available, for example 0.1 pF to 10 pF. The tuning speed of the tunable dielectric capacitors is typically about 30 ns. The voltage bias circuits, which can include radio frequency isolation components such as a series inductance, determine practical tuning speed. The tunable dielectric capacitor is a packaged two-port component, in which tunable dielectric can be voltage-controlled. The tunable film can be deposited on a substrate, such as MgO, $LaAlO_3$, sapphire, $Al_2O_3$ and other dielectric substrates. An applied voltage produces an electric field across the tunable dielectric, which produces an overall change in the capacitance of the tunable dielectric capacitor.

Tunable dielectric materials have been described in several patents. Barium strontium titanate ($BaTiO_3$—$SrTiO_3$), also referred to as BSTO, is used for its high dielectric constant (200–6,000) and large change in dielectric constant with applied voltage (25–75 percent with a field of 2 Volts/micron). Barium strontium titanate is a preferred electronically tunable dielectric material due to its favorable tuning characteristics, low Curie temperatures and low microwave loss properties. In the formula $Ba_xSr_{1-x}TiO_3$, x can be any value from 0 to 1, preferably from about 0.15 to about 0.6. More preferably, x is from 0.3 to 0.6.

Other electronically tunable dielectric materials may be used partially or entirely in place of barium strontium titanate. An example is $Ba_xCa_{1-x}TiO_3$, where x is in a range from about 0.2 to about 0.8, preferably from about 0.4 to about 0.6. Additional electronically tunable ferroelectrics include $Pb_xZr_{1-x}TiO_3$ (PZT) where x ranges from about 0.0 to about 1.0, $Pb_xZr_{1-x}SrTiO_3$ where x ranges from about 0.05 to about 0.4, $KTa_xNb_{1-x}O_3$ where x ranges from about 0.0 to about 1.0, lead lanthanum zirconium titanate (PLZT), $PbTiO_3$, $BaCaZrTiO_3$, $NaNO_3$, $KNbO_3$, $LiNbO_3$, $LiTaO_3$, $PbNb_2O_6$, $PbTa_2O_6$, $KSr(NbO_3)$ and $NaBa_2(NbO_3)_5$ $KH_2PO_4$, and mixtures and combinations thereof. Also, these materials can be combined with low loss dielectric materials, such as magnesium oxide (MgO), aluminum oxide ($Al_2O_3$), and zirconium oxide ($ZrO_2$), and/or with additional doping elements, such as manganese (MN), iron (Fe), and tungsten (W), or with other alkali earth metal oxides (i.e. calcium oxide, etc.), transition metal oxides, silicates, niobates, tantalates, aluminates, zirconnates, and titanates to further reduce the dielectric loss.

The tunable dielectric materials can also be combined with one or more non-tunable dielectric materials. The non-tunable phase(s) may include MgO, $MgAl_2O_4$, $MgTiO_3$, $Mg_2SiO_4$, $CaSiO_3$, $MgSrZrTiO_6$, $CaTiO_3$, $Al_2O_3$, $SiO_2$ and/or other metal silicates such as $BaSiO_3$ and $SrSiO_3$, and combinations thereof. The non-tunable dielectric phases may be any combination of the above, e.g., MgO combined with $MgTiO_3$, MgO combined with $MgSrZrTiO_6$, MgO combined with $Mg_2SiO_4$, MgO combined with $Mg_2SiO_4$, $Mg_2SiO_4$ combined with $CaTiO_3$ and the like.

Additional minor additives in amounts of from about 0.1 to about 5 weight percent can be added to the composites to additionally improve the electronic properties of the films. These minor additives include oxides such as zirconnates, tannates, rare earths, niobates and tantalates. For example, the minor additives may include $CaZrO_3$, $BaZrO_3$, $SrZrO_3$, $BaSnO_3$, $CaSnO_3$, $MgSnO_3$, $Bi_2O_3/2SnO_2$, $Nd_2O_3$, $Pr_7O_{11}$, $Yb_2O_3$, $Ho_2O_3$, $La_2O_3$, $MgNb_2O_6$, $SrNb_2O_6$, $BaNb_2O_6$, $MgTa_2O_6$, $BaTa_2O_6$ and $Ta_2O_3$, and combinations thereof.

Thick films of tunable dielectric composites can comprise $Ba_{1-x}Sr_xTiO_3$, where x is from 0.3 to 0.7 in combination with at least one non-tunable dielectric phase selected from MgO, $MgTiO_3$, $MgZrO_3$, $MgSrZrTiO_6$, $Mg_2SiO_4$, $CaSiO_3$, $MgAl_2O_4$, $CaTiO_3$, $Al_2O_3$, $SiO_2$, $BaSiO_3$ and $SrSiO_3$, and combinations thereof. These compositions can be BSTO and one of these components, or two or more of these components in quantities from 0.25 weight percent to 80 weight percent with BSTO weight ratios of 99.75 weight percent to 20 weight percent.

The electronically tunable materials can also include at least one metal silicate phase. The metal silicates may include metals from Group 2A of the Periodic Table, i.e., Be, Mg, Ca, Sr, Ba and Ra, preferably Mg, Ca, Sr and Ba. Preferred metal silicates include $Mg_2SiO_4$, $CaSiO_3$, $BaSiO_3$ and $SrSiO_3$. In addition to Group 2A metals, the present metal silicates may include metals from Group 1A, i.e., Li, Na, K, Rb, Cs and Fr, preferably Li, Na and K. For example, such metal silicates may include sodium silicates such as $Na_2SiO_3$ and $NaSiO_3$-$5H_2O$, and lithium-containing silicates such as $LiAlSiO_4$, $Li_2SiO_3$ and $Li_4SiO_4$. Metals from Groups 3A, 4A and some transition metals of the Periodic Table may also be suitable constituents of the metal silicate phase. Additional metal silicates may include $Al_2Si_2O_7$, $ZrSiO_4$, $KalSi_3O_8$, $NaAlSi_3O_8$, $CaAl_2Si_2O_8$, $CaMgSi_2O_6$, $BaTiSi_3O_9$ and $Zn_2SiO_4$. The above tunable materials can be tuned at room temperature by controlling an electric field that is applied across the materials.

In addition to the electronically tunable dielectric phase, the electronically tunable materials can include at least two additional metal oxide phases. The additional metal oxides may include metals from Group 2A of the Periodic Table, i.e., Mg, Ca, Sr, Ba, Be and Ra, preferably Mg, Ca, Sr and Ba. The additional metal oxides may also include metals from Group 1A, i.e., Li, Na, K, Rb, Cs and Fr, preferably Li, Na and K. Metals from other Groups of the Periodic Table may also be suitable constituents of the metal oxide phases. For example, refractory metals such as Ti, V, Cr, Mn, Zr, Nb, Mo, Hf, Ta and W may be used. Furthermore, metals such as Al, Si, Sn, Pb and Bi may be used. In addition, the metal oxide phases may comprise rare earth metals such as Sc, Y, La, Ce, Pr, Nd and the like.

The additional metal oxides may include, for example, zirconnates, silicates, titanates, aluminates, stannates, niobates, tantalates and rare earth oxides. Preferred additional metal oxides include $Mg_2SiO_4$, MgO, $CaTiO_3$, $MgZrSrTiO_6$, $MgTiO_3$, $MgAl_2O_4$, $WO_3$, $SnTiO_4$, $ZrTiO_4$, $CaSiO_3$, $CaSnO_3$, $CaWO_4$, $CaZrO_3$, $MgTa_2O_6$, $MgZrO_3$, $MnO_2$, PbO, $Bi_2O_3$ and $La_2O_3$. Particularly preferred additional metal oxides include $Mg_2SiO_4$, MgO, $CaTiO_3$, $MgZrSrTiO_6$, $MgTiO_3$, $MgAl_2O_4$, $MgTa_2O_6$ and $MgZrO_3$.

The additional metal oxide phases are typically present in total amounts of from about 1 to about 80 weight percent of the material, preferably from about 3 to about 65 weight percent, and more preferably from about 5 to about 60 weight percent. In one example, the additional metal oxides comprise from about 10 to about 50 total weight percent of the material. The individual amount of each additional metal oxide may be adjusted to provide the desired properties. Where two additional metal oxides are used, their weight ratios may vary, for example, from about 1:100 to about 100:1, typically from about 1:10 to about 10:1 or from about 1:5 to about 5:1. Although metal oxides in total amounts of from 1 to 80 weight percent are typically used, smaller additive amounts of from 0.01 to 1 weight percent may be used for some applications.

In another example, the additional metal oxide phases may include at least two Mg-containing compounds. In addition to the multiple Mg-containing compounds, the material may optionally include Mg-free compounds, for example, oxides of metals selected from Si, Ca, Zr, Ti, Al and/or rare earths. In another embodiment, the additional metal oxide phases may include a single Mg-containing compound and at least one Mg-free compound, for example, oxides of metals selected from Si, Ca, Zr, Ti, Al and/or rare earths.

The combination of tunable dielectric materials such as BSTO with additional metal oxides allows the materials to have high tunability, low insertion losses and tailorable dielectric properties, such that they can be used in microwave frequency applications. The materials demonstrate improved properties such as increased tuning, reduced loss tangents, reasonable dielectric constants for many microwave applications, stable voltage fatigue properties, higher breakdown levels than previous state of the art materials, and improved sintering characteristics. The tunable materials described above operate at room temperature. The electronically tunable materials may be provided in several manufacturable forms such as bulk ceramics, thick film dielectrics and thin film dielectrics.

To construct a tunable device, the tunable dielectric material can be deposited onto a low loss substrate. In some instances, such as where thin film devices are used, a buffer layer of tunable material, having the same composition as a main tunable layer, or having a different composition can be inserted between the substrate and the main tunable layer. The low loss dielectric substrate can include magnesium oxide (MgO), aluminum oxide ($Al_2O_3$), and lanthium oxide ($LaAl_2O_3$).

Compared to semiconductor varactor based tunable filters, tunable dielectric capacitor based tunable filters have the merits of higher Q, lower loss, higher power-handling, and higher IP3, especially at higher frequencies (>10 GHz). However, for certain applications of the invention, semiconductor diode varactors can be used.

Tunable capacitors based on microelectromachanical (MEM) technology can also be used in place of the varactors. At least two tunable capacitor topologies can be used, parallel plate and interdigital. In a parallel plate structure, one of the plates is suspended at a distance from the other plate by suspension springs. This distance can vary in response to an electrostatic force between two parallel plates induced by an applied bias voltage. In the interdigital configuration, the effective area of the capacitor is varied by moving the fingers comprising the capacitor in and out, thereby changing its capacitance value. MEM varactors have lower Q than their dielectric counterpart, especially at higher frequencies, but can be used in low frequency applications.

This invention provides a hairpin resonator and microstrip line filter structure, which provides transmission zeros without any cross couplings between non-adjacent resonators. This invention improves the filter selectivity without complicating the filter coupling topology, and makes the microstrip line bandpass filter electrically tunable.

While the invention has been described in terms of a two pole filter embodiment, filters with more resonators can be constructed in accordance with the invention to achieve similar performance. Therefore, different filter designs, such as a different number of poles or different filter design topologies, are also encompassed by this invention, as long as they include a varactor tuned hairpin resonator to achieve transmission zeros.

What is claimed is:

1. An electronic filter comprising:

a first microstrip line hairpin resonator including first and second arms;

a first varactor connected between a first end of the first arm and a first end of the second arm of the first microstrip line hairpin resonator, said first varactor comprising a layer of tunable dielectric material and first and second electrodes positioned adjacent to the layer of tunable dielectric material;

a first capacitor connected between a second end of the first arm and a second end of the second arm of the first microstrip line hairpin resonator;

the first and second arms being coupled to provide a first transmission zero;

an input coupled to the first microstrip line hairpin resonator;

a second microstrip line hairpin resonator including third and fourth arms;

a second varactor connected between a first end of the third arm and a first end of the fourth arm of the second microstrip line hairpin resonator, said second varactor comprising a layer of tunable dielectric material and first and second electrodes positioned adjacent to the layer of tunable dielectric material;

a second capacitor connected between a second end of the third arm and a second end of the fourth arm of the second microstrip line hairpin resonator;

the third and fourth arms being coupled to provide a second transmission zero; and an output coupled to the second microstrip line hairpin resonator.

2. An electronic filter according to claim 1, wherein:

the first and second arms are substantially parallel to each other.

3. An electronic filter according to claim 2, wherein:

the third and fourth arms are substantially parallel to each other.

4. An electronic filter according to claim 1, further comprising:

means for connecting a control voltage to each of the first and second varactors.

5. An electronic filter according to claim 4, wherein the means for connecting a control voltage to each of the first and second varactors comprises:

a first DC voltage supply connected the first resonator through first and second resistors; and a second DC voltage supply connected the second resonator through third and fourth resistors.

6. An electronic filter according to claim 1, wherein:

the first and second microstrip line hairpin resonators are coupled to form a Chebyshev or elliptical type of filter response.

7. An electronic filter according to claim 1, wherein each of the varactors comprises:

a semiconductor diode varactor.

8. An electronic filter according to claim 1, wherein the layer of tunable dielectric material comprises:

barium strontium titanate or a composite of barium strontium titanate.

9. An electronic filter according to claim 1, wherein the layer of tunable dielectric material further comprises a non-tunable component.

10. An electronic filter according to claim 1, wherein the layer of tunable dielectric material comprises a material selected from the group of:

BaxSr1-xTiO3, BaxCa1-xTiO3, PbxZr1-xTiO3, PbxZr1-xSrTiO3, KTaxNb1-xO3, lead lanthanum zirconium titanate, PbTiO3, BaCaZrTiO3, NaNO3, KNbO3, LiNbO3, LiTaO3, PbNb2O6, PbTa2O6, KSr(NbO3) and NaBa2(NbO3)5KH2PO4, and combinations thereof.

11. An electronic filter according to claim 1, wherein the layer of tunable dielectric material further comprises a material selected from the group of:

MgO, MgTiO3, MgZrO3, MgSrZrTiO6, Mg2SiO4, CaSiO3, MgAl2O4, CaTiO3, Al2O3, SiO2, BaSiO3 and SrSiO3, and combinations thereof.

12. An electronic filter according to claim 1, wherein the layer of tunable dielectric material further comprises a material selected from the group of:

$CaZrO_3$, $BaZrO_3$, $SrZrO_3$, $BaSnO_3$, $CaSnO_3$, $MgSnO_3$, $Bi_2O_3/2SnO_2$, $Nd_2O_3$, $Pr_7O_{11}$, $Yb_2O_3$, $Ho_2O_3$, $La_2O_3$, $MgNb_2O_6$, $SrNb_2O_6$, $BaNb_2O_6$, $MgTa_2O_6$, $BaTa_2O_6$ and $Ta_2O_3$, and combinations thereof.

13. An electronic filter according to claim 1, wherein the layer of tunable dielectric material further comprises at least one metal silicate phase.

14. An electronic filter according to claim 1, wherein the layer of tunable dielectric material further comprises at least two metal oxide phases.

15. A resonator for an electronic filter comprising:

first and second microstrip arms positioned substantially parallel to each other and coupled to provide a transmission zero in a frequency band of interest;

a varactor connected between a first end of the first microstrip arm and a first end of the second microstrip arm, said varactor comprising a layer of tunable dielectric material and first and second electrodes positioned adjacent to the layer of tunable dielectric material; and a first capacitor connected between a second end of the first microstrip arm and a second end of the second microstrip arm.

16. A resonator according to claim 15, wherein the varactor comprises:

a layer of tunable dielectric material; and first and second electrodes positioned adjacent to the layer of tunable dielectric material.

17. A resonator according to claim 16, wherein the layer of tunable dielectric material comprises:

barium strontium titanate or a composite of barium strontium titanate.

* * * * *